United States Patent [19]

Sjögren

[11] Patent Number: 4,840,054

[45] Date of Patent: Jun. 20, 1989

[54] ARRANGEMENT FOR PROFILING FORWARDLY INDEXED MATERIAL WEBS

[75] Inventor: Börje Sjögren, Huddinge, Sweden

[73] Assignee: Nordisk Kartro AB, Farsta, Sweden

[21] Appl. No.: 205,397

[22] PCT Filed: Oct. 23, 1987

[86] PCT No.: PCT/SE87/00491

§ 371 Date: Jun. 8, 1988

§ 102(e) Date: Jun. 8, 1988

[87] PCT Pub. No.: WO88/03067

PCT Pub. Date: May 5, 1988

[30] Foreign Application Priority Data

Oct. 24, 1986 [SE] Sweden ..... 8604557

[51] Int. Cl.[4] ..... B21D 13/02

[52] U.S. Cl. ..... 72/382; 72/385; 72/428

[58] Field of Search ..... 72/17, 380–382, 72/384–386, 389, 379, 420, 421, 428

[56] References Cited

U.S. PATENT DOCUMENTS

| | | | |
|---|---|---|---|
| 2,473,533 | 6/1949 | Lebedeff | 72/382 |
| 3,430,476 | 3/1969 | Duda | 72/190 |
| 3,673,846 | 7/1972 | Levington et al. | 72/384 |
| 4,450,706 | 5/1984 | Engelmohr | 72/385 |
| 4,627,258 | 12/1986 | Loges et al. | 72/196 |

FOREIGN PATENT DOCUMENTS

| | | | |
|---|---|---|---|
| 21363 | 10/1972 | Japan | 72/381 |
| 55-158836 | 12/1980 | Japan . | |
| 59-220220 | 12/1984 | Japan . | |
| 426495 | 4/1935 | United Kingdom . | |
| 566598 | 1/1945 | United Kingdom . | |
| 1022717 | 3/1966 | United Kingdom | 72/385 |

*Primary Examiner*—Robert L. Spruill

*Attorney, Agent, or Firm*—Young & Thompson

[57] ABSTRACT

An arrangement for profiling forwardly indexed material webs for producing e.g. parallel, transverse undulations in a sheet metal web (6) of uniform width which is forwardly indexed through a forming space (5) located between a lower bed (1) having a die (3) with an upwardly turned forming surface (4, 21) above which is a holding device (8) carrying a punch mechanism (7) reciprocatingly driven relative to the die (3) and executing a forming stroke while engaging the web and the forming surface of the die. An inclined ramp (22) guides the incoming web obliquely downwards towards the forming location (21) on the forming surface. Close to the ramp is a web support body (20) yielding transversely to the plane of the ramp when the web is stretched over the body during profiling by the forces of the punch mechanism (7) located beneath (9) the holding device which is formed as an attachment plate (8) movable in relation to the bed (1) and has a punch tool (10) extending from the plate (8) and a holding punch (12) axially movable along the punch tool and mounted on guide (13) attached to the plate (8) and held forwardly biased in an outwardly protruding position by spring devices (16) acting between the plate and the holding punch.

6 Claims, 1 Drawing Sheet

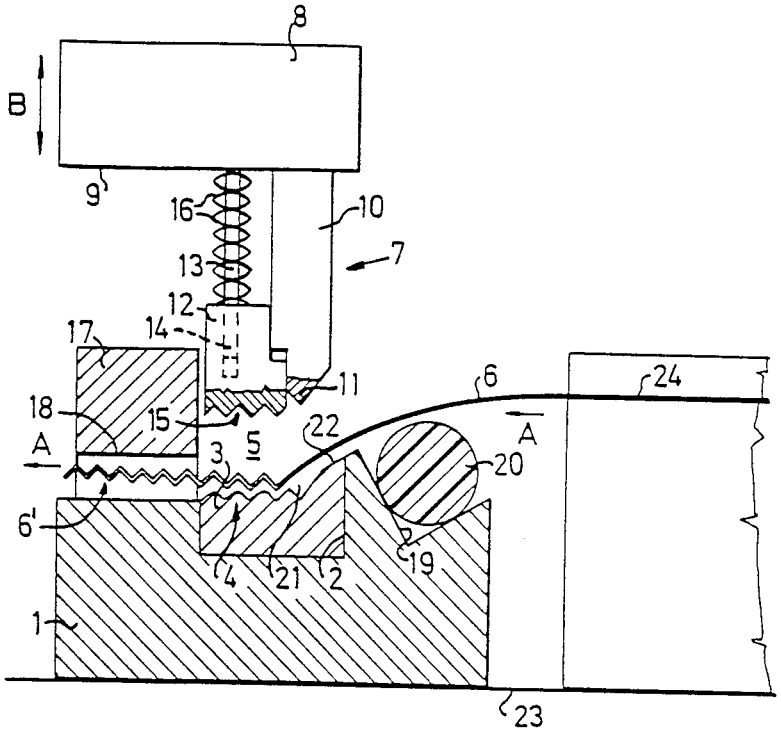
8
B
9
16
10
13
7
12
14
17
11
6
24
18
15
22
A
5
A
3
20
6'
19
4
21
2
1
23

ARRANGEMENT FOR PROFILING FORWARDLY INDEXED MATERIAL WEBS

The present invention arrangement relates to an arrangement for profiling a forwardly indexed material web, and more specifically for forming regularly occurring, mutually parallel, transverse corrugations or like folds in a sheet metal web, preferably of uniform width, during which the web is indexed forwardly through a forming space or area provided in the arrangement.

Thus, the invention relates to a technique which is primarily intended for profiling thin material webs, e.g. thin sheet metal strips, of uniform width in a manner to form mutually parallel, contiguous corrugations or folds that extend tranversely of the longitudinal axis of the strip. This technique can be applied, for instance, in the manufacture of strips of metal nails or like fasteners, i.e. nails formed in a common metal strip, in which the individual nails are given a specific profile (e.g. V-shaped configuration) and are each connected to a mutually adjacent nail through the intermediary of narrow tabs extending between the long sides of mutually adjacent nails. Nail strips of this kind are primarily intended for use in nail firing guns, for industrial purposes. Such guns are constructed to separate one nail at a time from the nail strip, during a nailing operation. One example of metal nail strips of the aforesaid kind is found described and illustrated in Swedish patent application Ser. No. 8504557-3.

The present invention is thus based on a technique in which the material web (the metal strip) is corrugated or likewise profiled by plastic deformation of the web material, more specifically by successive, stepwise bending of the web (strip), with the aid of a punch having a forming or shaping edge that extends transversely to the longitudinal axis of the web on one side thereof, e.g. a bending edge, and a die or forming bed which lies supportingly against the other side of the web and against which the punch executes a forming or shaping impact force (bending impact).

At the actual moment of forming a corrugation or like fold, i.e. at the precise moment when the forming tool is brought into impact engagement with the web (the strip) to deform the web material plastically, the forward feed of the web is stopped temporarily and the web held stationary. In order to ensure that the web material is deformed or folded at precisely the correct location on the web, upon engagement with the forming tool, so as to achieve the intended web configuration, for example a fold or corrugation which adjoins directly and immediately preceding fold or corrugation formed in the web by said forming tool, it has previously been necessary in practice to hold the web firmly on both sides of the location at which the forming tool is intended to engage the web. In this regard, the downstream section of the web (i.e. the web section that has already been profiled) is held stationary by means, for example, of a holding-down tool, which engages the profiled surfaces of the web (basic configurations) and holds the web firmly against the die/forming bed. If the upstream section of the web (i.e. the plain, non-profiled web section) is now held rigid, so as to be immovable, it is not possible in practice to prevent undesirable dilation, or excessive stretching, of the web material upon impact engagement of the forming tool with the web and subsequent deformation of the web material in the forming recess of the die/forming bed.

The problem on which the present invention is based is primarily one of preventing such stretching (dilation) of the web material when the web is subjected to impact shaping forces by the forming tool.

In accordance with the invention this problem is solved by means of an arrangement of the aforesaid kind which is characterized in that the forming or shaping space is located between a lower bed having mounted thereon a die having an upwardly turned forming surface thereon, and a holder device which is located above the forming space and which carries a punch mechanism that can be driven reciprocatingly towards and away from the die so as to be brought into forming engagement with the web, or metal strip, and the forming surface of the die; in that the arrangement also includes a ramp surface which slopes down towards the forming surface of the die and is operative to guide the material web into the forming or shaping location on said forming surface; and in that there is arranged in the vicinity of the ramp surface an elastically resilient web-support body which is capable of yielding resiliently transversely to the plane of the ramp surface in response to forces exerted on said body by the web when said web is stretched on the body as a result of forces exerted by the forming tool on the web during a profiling operation.

Thus, the basic, conceptual construction of the profiling arrangement is that the material web (the metal strip) is fed in towards the profiling location (the forming location) on the die forming surface at an angle to said location. The upstream section of the material web, or metal strip, will thus extend in an arc, over the elastically yielding support body and down to the forming surface of the die, along the downwardly sloping ramp surface. Because the support body is able to yield resiliently in response to stretching forces occurring in the web or strip when the forming tool engages the web and begins to deform the same, it is possible to pull the web forwards to the extent required in order to avoid the aforesaid stretching of the web, which web must also be either held firmly, or at least heavily braked (at the moment of deforming the web) at a location upstream of the support body.

In accordance with one advantageous embodiment of the profiling arrangement according to the invention, the punch mechanism is preferably located on the underside of the holder device, which may have the form of an attachment plate arranged for movement relative to the bed, and includes a punch tool attached to the attachment plate and extending vertically therefrom, e.g. a bending punch, and a holding punch, e.g. in the form of a holding-down tool, which can be moved axially adjacent one side of the tool punch and is mounted on guide means attached to the plate, and which is held forwardly biased by spring means acting between the plate and the holding-down tool.

The support body may have the form of a resiliently yieldable roll. The requisite degree of resilient yieldability to the forces exerted by the material web (the metal strip) can be achieved with a roll, which need not itself be made of a resiliently yieldable material provided that the roll is mounted on springs or suspended in a recess in the ramp surface or in the proximity of said surface. Alternatively, the roll may be made of a resiliently yieldable material, in which case the roll need not necessarily be mounted on springs or suspended in the aforesaid recess, provided that the resilient properties of the material from which the roll is made are sufficient to enable the elastic compression of the support body itself to subsequently stretch the material web, or metal strip, axially to the extent required. Alternatively, a combination of these features may be employed, in which the roll is both spring mounted/suspended and made of an elastic material that exhibits the aforesaid properties.

In present day machines or arrangements of this kind, there is a tendency for the profiled web to adhere to the forwardly located end of the punch mechanism upon upward movement of said mechanism from the die, subsequent to completing a profiling operation, and to be lifted to an unnecessary height above the bed and the die before releasing from the punch mechanism; in an extreme case it may be necessary to dislodge the web manually. Such occurrences can result in interruptions in operation, since they may interfere with, or even prevent, forward indexing of the profiled material web in preparation for the next following profiling stroke of the punch mechanism.

This complication can be avoided effectively by arranging in the region above that part of the bed over which the profiled web is advanced from the forming surface of the die, a web restraining device which limits the extent to which the web can be lifted from the bed, e.g. upon return movement of the punch mechanism away from the die.

The forming location preferably has the form of an indent or like recess located in the die and having a flank surface which forms an arcuate angle with the adjacent surface of the ramp, the ramp and the support body being so positioned and dimensioned in relation to one another that the web is forced to take an arcuate path over said ramp and said body when the forming tool is moved into engagement with the web and the forming indent.

The invention will now be described in more detail with reference to an exemplifying embodiment of a profiling arrangement according to the invention, illustrated schematically in the accompanying DRAWING, the single figure of which is a partial sectional view of the arrangement in vertical elevation.

As will be seen from the DRAWING, the arrangement comprises a bed in the form of an attachment base 1 mounted on a flat support surface. The upper part of the bed or base 1 has provided therein an upwardly open recess 2, which accommodates a die 3 having an upwardly facing forming or shaping surface 4. Arranged above the bed 1 and the forming surface 4 of the die 3 is a forming or shaping space in which a material web 6, advanced to the space by feed means (not shown) is indexed obliquely downwards into at least the close proximity of the forming surface 4, against which the web is deformed into the desired profiled configuration through the co-action of the die 3 with the downwardly facing forming tool of a punch mechanism 7. The profiled part of the material web, e.g. a metal strip, located downstream of the forming die 3 is referenced 6' in the drawing. The forward indexing of the material web 6,6' through the forming or shaping space 5 is thus effected in the direction shown by the arrows A.

The illustrated arrangement also includes a holding device 8 which is located above the forming space 6 and the bed 1 and which can be moved vertically, up and down, (vide the double-headed arrow B) with the aid of drive means not shown, so as to move the punch mechanism into and away from a position in which the forming tool 11 engages the plain metal section of the material web 6 advanced stepwise between the punch mechanism and the die 3.

The punch mechanism 7 is mounted on the undersurface 9 of the holding device 8, which has the form of an upper attachment plate capable of moving relative to the bed 1. The punch mechanism incorporates, inter alia, a tool punch which is attached to the plate 8 and which has the form of a bending press 10 which extends downwards from the undersurface of the plate 8. when seen in the vertical extension of the bending press 10, said press presents a forwardly located, lower forming edge 11, by means of which the material web 6 is deformed to the desired profiled shape, in this instance a V-shaped corrugation, in co-action with the underlying die 3. The punch mechanism 7 also includes a holding punch in the form of a spring-biased holding-down tool 12 which is arranged for vertical movement along an adjacent side of the tool punch 10. The holding down tool is mounted on guide means 13 attached to the plate 8. In the illustrated embodiment said guide means have the form of guide rods 13 which extend downwardly from the undersurface 9 of the plate 8 and enter corresponding bores 14 in the holding-down tool 12.

In the illustrated position of the punch mechanism 7, in which the punch tool is raised out of engagement with the material web, or metal strip 6, the holding-down tool 12 is held forwardly biased in a downwardly jutting position, in which the corrugated (saw-tooth configuration) undersurface 15 of said tool protrudes slightly beyond the plane of the forming edge 11 of the punch 10. The undersurface 15 of the punch tool 10 is therefore located "in front of" the forming edge 11 of the tool 10 and will consequently engage the V-shaped corrugations on the stamped section 6' of the material web prior to engagement of the forming edge 11 with the upstream plain section of the material web, as the punched mechanism 7 is driven down to its web profiling position. In the illustrated embodiment, the holding-down tool 12 is held forwardly biased by means of a thrust spring assembly 16 arranged on the rods 13 and positioned between the holding-down tool 12 and the undersurface of the plate 8.

In order to limit the extent to which the profiled material web section 6' can move vertically away from the upper surface of the bed 1, there is provided above the bed, at a short distance therefrom, a restraining device 17, the undersurface 18 of which facing the profiled web section 6' acts to restrain said section against excessive lift-off.

In order to hold the incoming plain material web 6, or metal strip, resiliently in tension during a profiling operation, the bed 1 has provided therein, to the right of the punch mechanism 7 as seen in the drawing, a resiliently yieldable, strip-supporting body 20, which in the illustrated embodiment has the form of a resiliently yieldable or sprung tensioning roll. It is assumed here that the illustrated support body comprises an elastic material, for example polyurethane rubber, having a degree of resilient compressability sufficient to afford the degree of resiliency required to hold the strip comfortably stretched when the body is subjected to the load exerted by the material web 6 located thereon when the web is stretched over the support body 20 as a result of the bending force exerted by the forming edge 11 during a profiling operation, this forming edge co-acting with a corresponding forming location in the form of an indent or like recess 21 in the die 3, so as to produce, in this case, a V-shaped fold in said web.

In order to enhance the resiliency of the support body 20 against the force exerted by the plain web section 6 (when stretched over the support body 20), the support body 20 may be mounted on spring means or resiliently suspended in a recess 19 particularly formed for this purpose.

Stretching of the plain material web section 6 over the support body 20 (in the initial stage of engagement of the forming edge 11 with the appropriate part of the web 6 for deformation of said part into the indent 21) is controlled by an inclined ramp 22 which slopes down from the recess 19 housing the support body 20 to the indent 21 located in the forming surface 4.

Tests have shown that in order to obtain satisfactory V-shaped corrugations in the material web, or metal strip, 6 it is beneficial to tension or stretch the incoming strip over a flat ramp surface, such as the ramp 22, having a geometric extension which intersects the horizontal plane 23 at a given angle thereto, the value of this angle being dependent on the thickness of the material web 6 and the length of the angled limbs of the V-shaped profile, and preferably being from 20° to 40°.

With regard to the manner in which the profiling arrangement operates, it shall be noted that the holding-down tool 12 urges the profiled strip section 6' into firm holding engagement with the correspondingly profiled upper surface 4 of the die 3 prior to the forming edge 11 of the punch 10 engaging the part of the plain material web 6 located above the forming indent 21. Thus, at the actual moment of deforming the web, the profiled web section 6' is effectively held firm by the holding-down tool 12, while allowing the plain web section 6 to be stretched to a given extent along the ramp 22 (due to the resilient yieldability of the support body 20), even though the plain web section 6 is, at the same time, held firmly and prevented from moving in the region 24 in the direction of arrow A, by a metal web feeding device not shown.

Subsequent to completing a downward working stroke against the material web (the metal strip) 6 on the die 3, therewith to form a corrugation in the web or strip, the punch mechanism 7 executes a return movement in which the punch is raised from the bed/die so as to enable the web to be freed from the die 3 and indexed forwards, one step, through the forming space 5, in readiness for the next working stroke of the punch mechanism 7. As the punch mechanism moves vertically away from the die, the web, or strip, is automatically lifted from the die forming surface 4 by the spring force exerted by the arcuately curved plain strip section, which curves from the newly deformed part of the web over the ramp 22 and the support body 20, as said section strives to straighten. The material web 6, or metal strip, is thus lifted from the forming surface 4 as a result of its inherent "restoring force" and therefore need only be indexed forwards through a distance corresponding to the dimension of the corrugation or like fold to be formed. Dilatation of the web material in the region of a corrugation as the web is deformed by engagement with the forming edge 11 of the punch 10 is avoided due to the fact that the forming edge 11 engages precisely that part of the material web which will ultimately form the bottom edge of the corrugation subsequent to folding said web part into the indent 21. Thus, the forming edge 11 of the punch 10 engages the web 6, from the very outset, at precisely that position thereon in which the ultimate folding edge of the corrugation is located, and maintains this precise position of engagement with said part of the web during the whole of the subsequent deformation of said part and the final formation of the fold at the bottom of the indent 21. In other words, the forming edge 11 engages the material web, or metal strip, 6, at a location thereon which is spaced from the bottom fold of an immediately preceding corrugation by a distance equal to the length of the two limbs of the angle subtended.

It will be understood that the aforedescribed and illustrated embodiment of the profiling arrangement according to the invention is merely intended to exemplify the general concept of the invention and that modifications can be made within the scope of the following claims.

I claim:

1. An arrangement for profiling a forwardly indexed material web (6), and more specifically for forming mutually parallel, transverse undulations in a sheet-metal web, which is preferably of uniform width and which is indexed forwardly through a forming space (5) provided in the arrangement, characterized in that the forming space (5) is located between a lower bed (1), which carries thereon a die (3) having an upwardly turned forming surface (4,21) comprising a forming location (21), and a holding device (8) located above the forming space and which carries a punch mechanism (7) driven reciprocatingly towards and away from the die (3) and which is arranged to be brought into forming or shaping impact with the web (6) and the forming surface (421) of the die; an inclined ramp surface (22) arranged adjacent said forming location to guide the material web obliquely downwards towards the forming location (21) on the forming surface of the die; and a resiliently yieldable web-support body (20) mounted in the proximity of the ramp surface for yielding resiliently in a direction transversely to the plane of the ramp surface when the web is stretched over the body as a result of forces exerted by the punch mechanism (7) on the web (6) during a profiling operation.

2. An arrangement according to claim 1, characterized in that the punch mechanism (7) is attached to the holding device having the form of an attachment plate (8) movable in relation to the bed (1), and includes a punch tool (10), e.g. a bending punch, which is attached to the plate and extends downwardly therefrom, and a holding punch (12), e.g. in the form of a holding-down tool, movable axially along the punch tool and is journalled on guide means (13) attached to the plate (8) and held forwardly biased in an outwardly protruding position by means of spring devices (16) acting between the plate (8) and the holding punch (12).

3. An arrangement according to claim 2, characterized in that the forming location comprises an indent (21) located in the die (3), said indent having a flank surface which forms an acute angle with an adjacent surface of the ramp (22), said ramp surface (22) and the support body (20) being so positioned and dimensioned in relation to one another that the web (6) is forced to take an arcuate path over said ramp surface and said body when the punch tool (10) is moved into engagement with the web and the forming indent (21).

4. An arrangement according to claim 1 characterized in that the resiliently yieldable web-support body (20) comprises a roll arranged in a recess (19) provided in the ramp surface (22) or located in the vicinity of said surface.

5. An arrangement according to claim 3, characterized in that the roll (20) is made of a resilient material, such as polyurethane rubber.

6. An arrangement according to claim 1, characterized by restraining means (17) arranged in the region above that part of the bed (1) over which the profiled section of the web (6') is fed from the forming surface (4,21) of the die (3), said restraining means being effective in restricting the extent to which the web can be lifted from the bed, for example upon return movement of the punch mechanism (7) away from the die.

* * * * *